US008137142B1

(12) United States Patent
Dawson et al.

(10) Patent No.: US 8,137,142 B1
(45) Date of Patent: Mar. 20, 2012

(54) CONNECTOR ASSEMBLY

(75) Inventors: Joshua Patrick Dawson, Livonia, MI (US); Jeremy Joseph Gagnon, Farmington, MI (US)

(73) Assignee: Yazaki North America, Inc., Canton, MI (US)

( * ) Notice: Subject to any disclaimer, the term of this patent is extended or adjusted under 35 U.S.C. 154(b) by 0 days.

(21) Appl. No.: 13/239,631

(22) Filed: Sep. 22, 2011

(51) Int. Cl.
*H01R 24/00* (2011.01)

(52) U.S. Cl. ..... 439/676

(58) Field of Classification Search ..... 439/606, 439/693, 106, 695, 696, 736
See application file for complete search history.

(56) References Cited

U.S. PATENT DOCUMENTS

| | | | | |
|---|---|---|---|---|
| 4,695,112 | A | 9/1987 | Maston et al. | |
| 4,705,337 | A | 11/1987 | Maeda | |
| 4,714,433 | A | 12/1987 | Rider, Jr. | |
| 4,820,198 | A | 4/1989 | Lulko et al. | |
| 5,190,476 | A | 3/1993 | Chaillot | |
| 5,575,683 | A | 11/1996 | Saito et al. | |
| 5,885,105 | A | 3/1999 | Takagishi et al. | |
| 6,022,238 | A | 2/2000 | Tomita et al. | |
| 6,106,340 | A | 8/2000 | Myer et al. | |
| 6,261,115 | B1 | 7/2001 | Pederson et al. | |
| 6,276,964 | B1 | 8/2001 | Shinozaki | |
| 6,312,277 | B1 | 11/2001 | Holub | |
| 6,352,449 | B1 | 3/2002 | Yasuda et al. | |
| 6,354,860 | B1 | 3/2002 | Miller et al. | |
| 6,406,319 | B2 | 6/2002 | Pederson et al. | |
| 6,716,052 | B2 | 4/2004 | Kane | |
| 6,780,045 | B2 | 8/2004 | Shuey et al. | |
| 6,796,837 | B2 | 9/2004 | Fukatsu et al. | |
| 6,939,159 | B1 * | 9/2005 | Klein et al. | 439/352 |
| 6,945,801 | B2 | 9/2005 | Brown | |
| 7,048,581 | B1 | 5/2006 | Wong | |
| 7,201,599 | B2 | 4/2007 | Holub | |
| 7,306,486 | B2 | 12/2007 | Takeda et al. | |
| 7,338,317 | B1 | 3/2008 | Nagy | |
| 7,404,731 | B2 * | 7/2008 | Lim | 439/489 |
| 7,611,365 | B1 | 11/2009 | Ng et al. | |
| 7,661,986 | B2 | 2/2010 | Maesoba et al. | |
| 7,661,999 | B2 | 2/2010 | Horiuchi et al. | |
| 7,749,023 | B2 * | 7/2010 | Simmel et al. | 439/595 |
| 7,785,146 | B2 * | 8/2010 | Chazottes et al. | 439/595 |
| 2009/0247011 | A1 | 10/2009 | Myer et al. | |
| 2009/0298320 | A1 | 12/2009 | Schmitt et al. | |
| 2009/0318022 | A1 | 12/2009 | Simmel et al. | |

* cited by examiner

*Primary Examiner* — Tulsidas C Patel
*Assistant Examiner* — Phuong Nguyen
(74) *Attorney, Agent, or Firm* — Harness, Dickey & Pierce, P.L.C.

(57) ABSTRACT

A connector assembly can include a first housing, a second housing and a connector position assurance insert. The second housing can be configured to mate with the first housing in a mated configuration such that a first electrical terminal and a second electrical terminal are coupled. The connector position assurance insert can be coupled to the first and second housing in the mated configuration and can include a first flexible lock member at a first end and a second flexible lock member at a second end opposite the first end. In the mated configuration, the first flexible lock member mates with the first locking feature and the second flexible lock member mates with the second locking feature such that the first housing, the second housing and the connector position assurance insert are fixedly secured at an appropriate locked position.

15 Claims, 4 Drawing Sheets

CONNECTOR ASSEMBLY

FIELD

The present disclosure relates to an electrical connector assembly and, more particularly, to an electrical connector assembly with an improved connector position assurance insert.

BACKGROUND

The background description provided herein is for the purpose of generally presenting the context of the disclosure. Work of the presently named inventors, to the extent the work is described in this background section, as well as aspects of the description that may not otherwise qualify as prior art at the time of filing, are neither expressly nor impliedly admitted as prior art against the present disclosure.

Traditionally, electrical connectors can be used to couple, join or electrically connect various electrical components together to enable data, current, etc. to flow between the electrical components. For example, an electrical component can include one or more electrical wires, which can be joined together at a terminal. The terminal can be configured to mate with a corresponding terminal, in a male-female or other fashion. The electrical connector can facilitate the engagement of the male terminal with the female terminal, and the electrical connector can be configured to resist the disengagement of the female terminal from the male terminal.

Generally, electrical connectors can be used in motor vehicles due to their compact size. A typical connector can include a male housing that can surround a male terminal, and a female housing that can surround a female terminal. In order to mate the male housing with the female housing, an operator (assembler, machine, etc.) may push the female housing into the male housing to enter a mated configuration. In order to securely lock the female and male housings in the mated configuration, a connector position assurance insert can be mated with the female and male housings in the mated configuration. During the assembly process and/or during disassembly and re-assembly of the connector, a typical connector position assurance insert can become deformed or otherwise become unsuitable for securely locking the housings in the mated configuration.

It would be desirable to provide for a connector assembly with an improved connector position assurance insert in order to reduce the issues identified above.

SUMMARY

In accordance with various embodiments of the present disclosure, a connector assembly is disclosed. The connector assembly can include a first housing, a second housing and a connector position assurance insert. The first housing can define a bore for receipt of at least one first electrical terminal and can include a first locking feature. The second housing can define a bore for receipt of at least one second electrical terminal and can include a second locking feature. The second housing can be configured to mate with the first housing in a mated configuration such that the at least one first electrical terminal and the at least one second electrical terminal are coupled. The connector position assurance insert can be coupled to the first and second housing in the mated configuration and can include a first flexible lock member at a first end and a second flexible lock member at a second end opposite the first end. In the mated configuration, the first flexible lock member mates with the first locking feature and the second flexible lock member mates with the second locking feature such that the first housing, the second housing and the connector position assurance insert are fixedly secured at an appropriate locked position.

In accordance with various embodiments of the present disclosure, a connector assembly is disclosed. The connector assembly can include a first housing, a second housing and a connector position assurance insert. The first housing can define a bore for receipt of at least one first electrical terminal and can include a first locking feature. The second housing can define a bore for receipt of at least one second electrical terminal and can include a second locking feature. The second housing can be configured to mate with the first housing in a mated configuration such that the at least one first electrical terminal and the at least one second electrical terminal are coupled. The connector position assurance insert can be coupled to the first and second housing in the mated configuration and can include a first flexible free floating projection at a first end and a second flexible free floating projection at a second end opposite the first end. In the mated configuration, the first flexible free floating projection mates with the first locking feature and the second flexible free floating projection mates with the second locking feature such that the first housing, the second housing and the connector position assurance insert are fixedly secured at an appropriate locked position.

In accordance with various embodiments of the present disclosure, a connector assembly is disclosed. The connector assembly can include a first housing, a second housing and a connector position assurance insert. The first housing can define a bore for receipt of at least one first electrical terminal and can include a first locking feature. The second housing can define a bore for receipt of at least one second electrical terminal and can include a second locking feature. The second housing can be configured to mate with the first housing in a mated configuration such that the at least one first electrical terminal and the at least one second electrical terminal are coupled. The connector position assurance insert can be coupled to the first and second housing in the mated configuration and can include a first flexible lock member at a first end and a second flexible lock member at a second end opposite the first end. The first flexible lock member can include a main body portion and a free floating projection arranged within and surrounded by the main body portion. The free floating projection can be configured to flex as the connector position assurance insert is being coupled to the first housing. In the mated configuration, the free floating projection mates with the first locking feature and the second flexible lock member mates with the second locking feature such that the first housing, the second housing and the connector position assurance insert are fixedly secured at an appropriate locked position.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF DRAWINGS

The present disclosure will become more fully understood from the detailed description and the accompanying drawings, wherein.

DESCRIPTION

Figure 1:
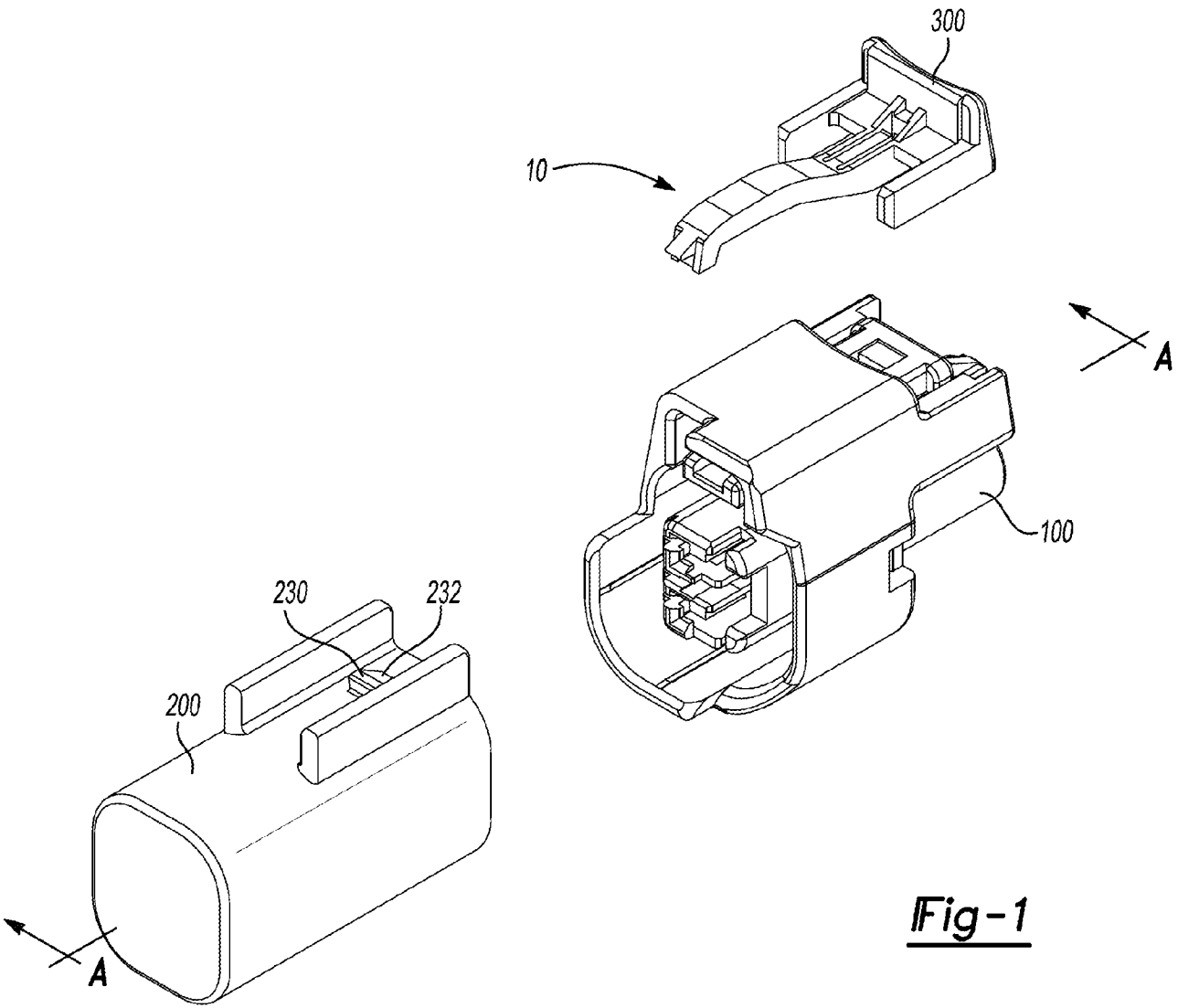
FIG. 1 is a perspective view of an exemplary connector assembly, including a connector position assurance insert, according to various embodiments of the present disclosure.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

Referring now to FIG. 1, an exemplary connector assembly 10 according to various embodiments of the present disclosure is illustrated. The connector assembly 10 includes a first housing 100, a second housing 200 and a connector position assurance insert 300. The connector assembly 10 is shown in the mated configuration in FIG. 1, that is, where the first housing 100, second housing 200 and connector position assurance insert 300 are secured together at an appropriate locked position.

Figure 2:
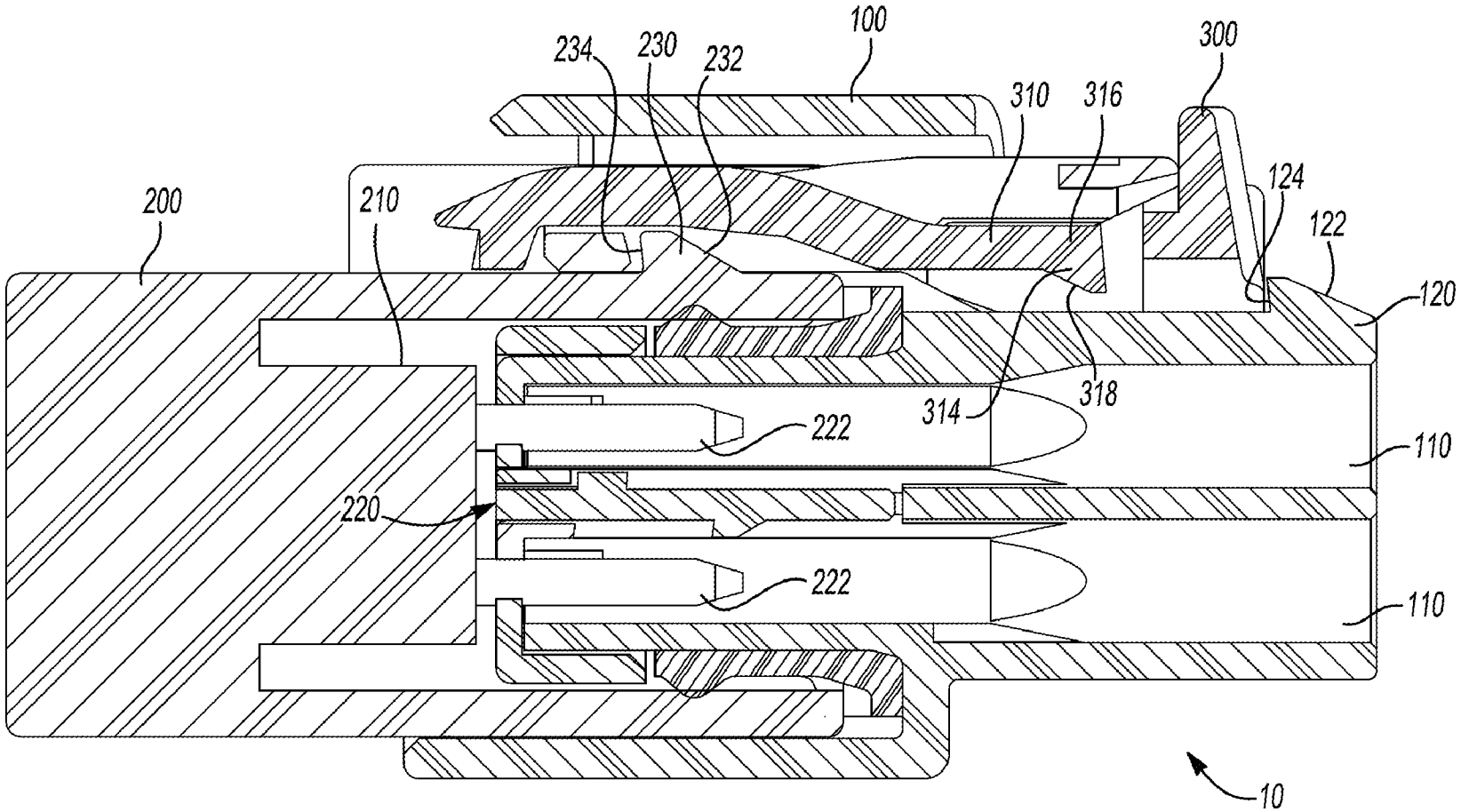
FIG. 2 is a sectional view of the exemplary connector assembly of FIG. 1.

With further reference to FIG. 2, the first housing 100 can define at least one bore 110 for receiving an electrical terminal and/or electrical wire (not shown). The at least one bore 110 can be configured to receive an electrical terminal in a sealed engagement, for example, due to a tight interference fit and/or the inclusion of a seal member (not shown) that sealingly engages both the at least one bore 110 and the electrical wire/terminal. In the illustrated example, the first housing 100 defines two bores 110.

The first housing 100 can further include a first locking feature 120. In the illustrated example, the first locking feature 120 includes a ramp portion 122 and a stop portion 124. The first locking feature 120, as described more fully below, can assist in locking the connector position assurance insert 300 to the first housing 100.

The second housing 200 can define at least one bore 210 for receiving an electrical terminal and/or electrical wire (not shown). The at least one bore 210 can be configured to receive an electrical terminal in a sealed engagement, for example, due to a tight interference fit and/or the inclusion of a seal member (not shown) that sealingly engages both the at least one bore 210 and the electrical wire/terminal. Further, the second housing 200 can be configured to mate with the first housing 100 in a mated configuration (FIG. 2) such that the first electrical terminal(s) in the first housing 100 and the second terminal(s) in the second housing 200 are coupled. In the illustrated example, the second housing 200 includes a terminal 220 that includes two prongs 222 configured to be received within the two bores 110 of the first housing 100 and mate with the electrical terminals (not shown) therein.

The second housing 200 can further include a second locking feature 230. In the illustrated example, the second locking feature 230 includes a ramp portion 232 and a stop portion 234. The first locking feature 230, as described more fully below, can assist in locking the second housing 200 to the first housing 100 and the connector position assurance insert 300.

Figure 3A:
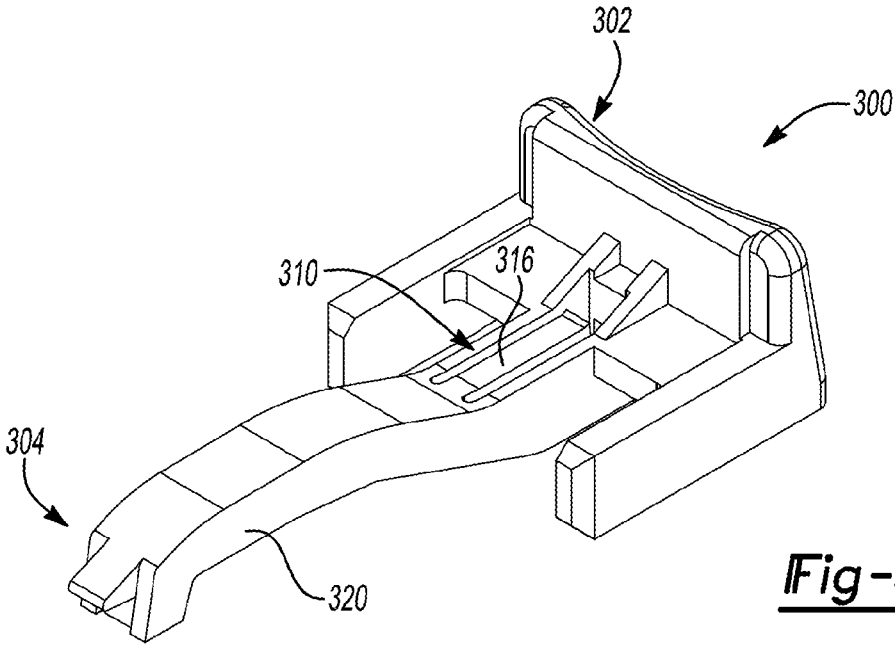
FIGS. 3A and 3B are perspective and top views, respectively, of the connector position assurance insert of FIG. 1.
Figure 3B:
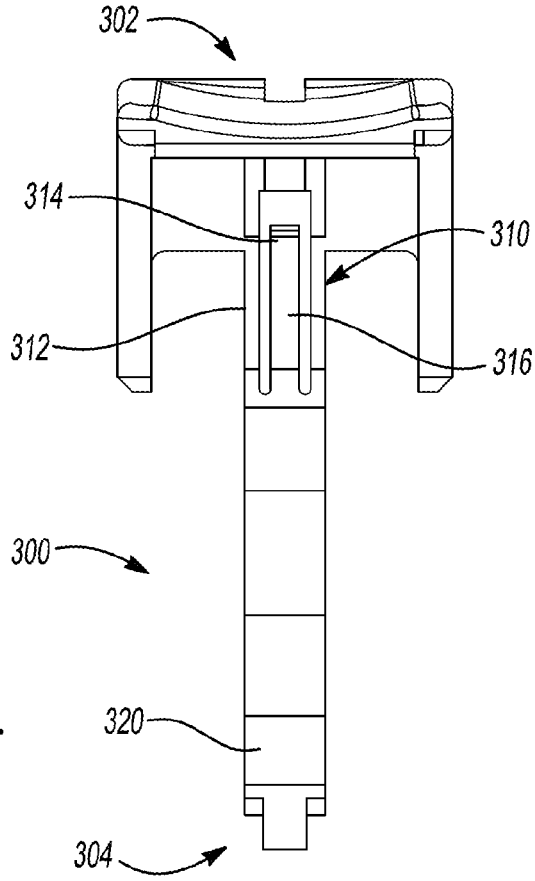

With further reference to FIGS. 3A and 3B, the connector position assurance insert 300 can include a first flexible lock member 310 and a second flexible lock member 320. The first flexible lock member 310 can be arranged at a first end 302 of the connector position assurance insert 300, while the second flexible lock member 320 can be arranged at a second end 304 of connector position assurance insert 300. In some embodiments and as shown in the illustrated example, the first end 302 can be opposite the second end 304. In the mated configuration (FIG. 2), the first flexible lock member 310 mates with the first locking feature 120 of the first housing 100 and the second flexible lock member 320 mates with the second locking feature 230 to fixedly secure the first housing 100, second housing 200 and connector position assurance insert 300 at the appropriate locked position.

In some embodiments, the first flexible lock member 310 includes a main body portion 312 and a free floating projection 314. The free floating projection 314 can be arranged within the main body portion 312. In this manner, the free floating projection 314 can be at least partially surrounded by the main body portion 312. This arrangement provides for the first flexible lock member 310 to be arranged at an appropriate position within the connector position assurance insert 300, while also providing the flexibility needed for optimal performance. As described more fully below, the free floating projection 314 can be configured to flex as the connector position assurance insert 300 is being coupled to the first and second housings 100, 200.

The first flexible lock member 310 can further include a lever portion 316 and a ramp portion 318. The lever portion 316 can be configured to be both flexible and resilient such that the connector position assurance insert 300 flexes during coupling with the first and second housings 100, 200. For example only, the ramp portion 318 can interact with the ramp portion 122 as the connector position assurance insert 300 is coupled with the first and second housings 100, 200 and is moved to the appropriate locked position shown in FIG. 2. The first flexible lock member 310 can also include a first stop 319. The first stop 319 can interact with the first housing 100, for example the stop portion 124 of the first locking feature 120, to inhibit movement of the connector position assurance insert 300 from the appropriate locked position.

In some embodiments, the second flexible lock member 320 includes a lever portion 322 and a second stop 324. As described more fully below, the lever portion 322 can be configured to flex as the connector position assurance insert 300 is being coupled to the first and second housings 100, 200. The second stop 324 can be configured to interact with the first housing 100, e.g., the first locking feature 120 or a catch 130, to inhibit movement of the connector position assurance insert 300 from the appropriate locked position. For example only, the first stop 319 and the second stop 324 can inhibit decoupling of the connector position assurance insert 300 from the first and second housings 100, 200 when in the mated configuration.

Figure 4A:
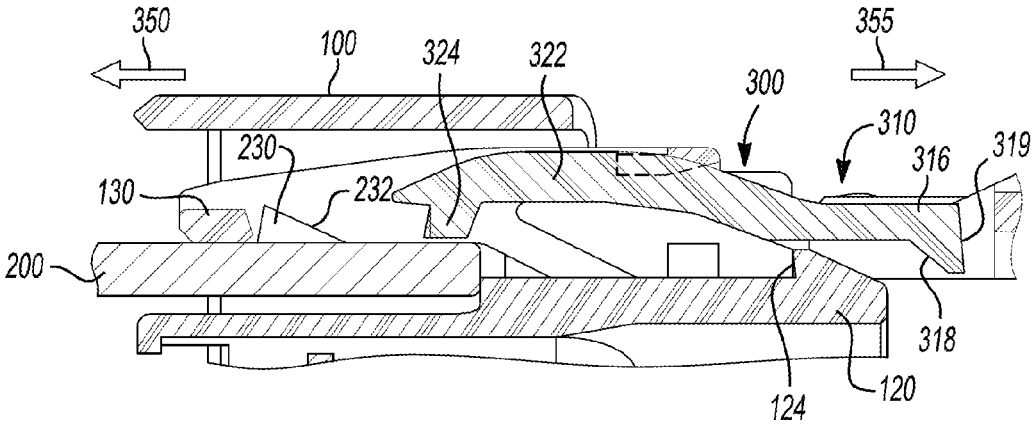
FIGS. 4A, 4B and 4C are partial sectional views of the exemplary connector assembly of FIG. 1 at different stages of assembly.
Figure 4B:
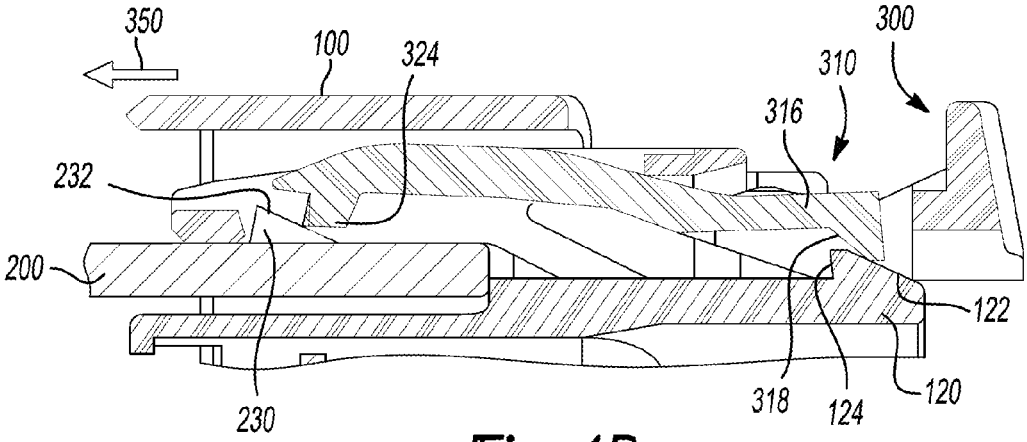
Figure 4C:
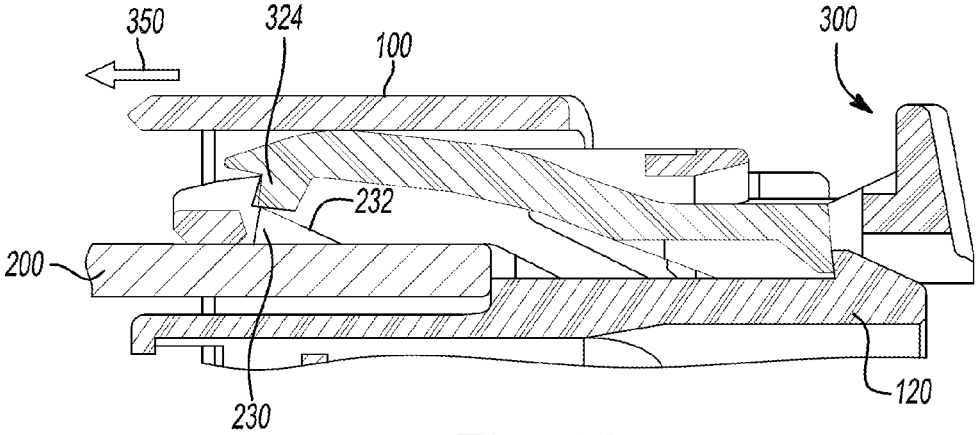

Referring now to FIGS. 4A, 4B and 4C, the connector assembly 10 is shown in a number of states between the unassembled configuration and the fully mated configuration of FIG. 2. In FIG. 4A, the first and second housings 100, 200 are shown mated together, while the connector position assurance insert 300 is disengaged. The first and second housings 100, 200 can be coupled together, for example, by utilizing the second locking feature 230 of the second housing 200 to mate with and engage the catch 130 formed in the first housing 100.

Once the first and second housings 100, 200 are mated, the connector position assurance insert 300 may be moved in the direction of arrow 350 to be coupled to the first and second housings 100, 200. As the connector position assurance insert 300 is being coupled with the first and second housings 100, 200, the first flexible lock member 310 flexes (FIG. 4B). More specifically, to continue with the example shown in FIG. 4B, the ramp portion 318 of the first flexible lock member 310 interacts with the ramp portion 122 of the first locking feature 120 to flex the free floating projection 314. Additionally, the second flexible lock member 320 (for example, the second stop 324) may interact with the second locking feature 230 (for example, the ramp portion 232) such that the lever portion 322 flexes. As shown in FIG. 4C, the first stop 319 of the first flexible lock member 310 can interact with the stop portion 124 of the first housing 100 to inhibit decoupling of the connection position assurance insert 300 from the first housing 100, i.e., inhibit movement of the connection position assurance insert 300 in the direction of arrow 355.

As the connection position assurance insert 300 is further moved in the direction of arrow 350 from the position shown in FIG. 4C, the lever portion 322 further flexes until the second stop 324 moves past the catch 130. At this point, due to the resilience of the connection position assurance insert 300, and specifically the lever 322, the connection position assurance insert 300 enters the fully mated configuration to enter the appropriate locked position.

The broad teachings of the disclosure can be implemented in a variety of forms. Therefore, while this disclosure includes particular examples, the true scope of the disclosure should not be so limited since other modifications will become apparent upon a study of the drawings, the specification, and the following claims.

What is claimed is:

1. A connector assembly, comprising:

a first housing that defines a bore for receipt of at least one first electrical terminal, the first housing including a first locking feature;

a second housing that defines a bore for receipt of at least one second electrical terminal, the second housing including a second locking feature and being configured to mate with the first housing in a mated configuration such that the at least one first electrical terminal and the at least one second electrical terminal are coupled; and a connector position assurance insert coupled to the first and second housing in the mated configuration, the connector position assurance insert including a first flexible lock member at a first end and a second flexible lock member at a second end opposite the first end, wherein the first flexible lock member includes a first stop that interacts with the first housing to inhibit movement of the connector position assurance insert from the appropriate locked position and the second flexible lock member includes a second stop that interacts with the first housing to inhibit movement of the connector position assurance insert from the appropriate locked position, wherein, in the mated configuration, the first flexible lock member mates with the first locking feature and the second flexible lock member mates with the second locking feature such that the first housing, the second housing and the connector position assurance insert are fixedly secured at an appropriate locked position, and wherein the first stop and the second stop inhibit decoupling of the connector position assurance insert from the first and second housings.

2. The connector assembly of claim 1, wherein the second flexible lock member includes a lever portion and a ramp portion, the lever portion configured to flex when the connector position assurance insert is being coupled to the first and second housings.

3. The connector assembly of claim 1, wherein the first locking feature includes a ramp portion that interacts with the first flexible lock member as the connector position assurance insert is being coupled to the first and second housings such that the first flexible lock member flexes.

4. The connector assembly of claim 1, wherein the first flexible lock member includes a main body portion and a free floating projection, the free floating projection configured to flex when the connector position assurance insert is being coupled to the first and second housings.

5. The connector assembly of claim 4, wherein the free floating projection is arranged within the main body portion.

6. The connector assembly of claim 5, wherein the free floating projection includes a lever portion and a ramp portion.

7. The connector assembly of claim 5, wherein the free floating projection is surrounded by the main body portion.

8. A connector assembly, comprising:

a first housing that defines a bore for receipt of at least one first electrical terminal, the first housing including a first locking feature;

a second housing that defines a bore for receipt of at least one second electrical terminal, the second housing including a second locking feature and being configured to mate with the first housing in a mated configuration such that the at least one first electrical terminal and the at least one second electrical terminal are coupled; and a connector position assurance insert coupled to the first and second housing in the mated configuration, the connector position assurance insert including a first flexible free floating projection at a first end and a second flexible free floating projection at a second end opposite the first end, wherein, in the mated configuration, the first flexible free floating projection mates with the first locking feature and the second flexible free floating projection mates with the second locking feature such that the first housing, the second housing and the connector position assurance insert are fixedly secured at an appropriate locked position, and wherein the connector position assurance insert further includes: (i) a first stop that interacts with the first housing to inhibit movement of the connector position assurance insert from the appropriate locked position, and (ii) a second stop that interacts with the second housing to inhibit movement of the connector position assurance insert from the appropriate locked position.

9. The connector assembly of claim 8, wherein the connector position assurance insert further includes a main body portion at least partially surrounding the first free floating projection, the first free floating projection configured to flex when the connector position assurance insert is being coupled to the first and second housings.

10. The connector assembly of claim 8, wherein the first stop and the second stop inhibit decoupling of the connector position assurance insert from the first and second housings.

11. A connector assembly, comprising:

a first housing that defines a bore for receipt of at least one first electrical terminal, the first housing including a first locking feature;

a second housing that defines a bore for receipt of at least one second electrical terminal, the second housing including a second locking feature and being configured to mate with the first housing in a mated configuration such that the at least one first electrical terminal and the at least one second electrical terminal are coupled; and a connector position assurance insert coupled to the first and second housing in the mated configuration, the connector position assurance insert including a first flexible lock member at a first end and a second flexible lock member at a second end opposite the first end, wherein: (i) the first flexible lock member includes a main body portion and a free floating projection arranged within and surrounded by the main body portion, (ii) the free floating projection is configured to flex as the connector position assurance insert is being coupled to the first housing, and (iii) in the mated configuration, the free floating projection mates with the first locking feature and the second flexible lock member mates with the second locking feature such that the first housing, the second housing and the connector position assurance insert are fixedly secured at an appropriate locked position, and wherein the second flexible lock member further includes a first stop that interacts with the first housing to inhibit movement of the connector position assurance insert from the appropriate locked position.

12. The connector assembly of claim 11, wherein the second flexible lock member includes a lever portion and a ramp portion, the lever portion configured to flex when the connector position assurance insert is being coupled to the first and second housings.

13. The connector assembly of claim 12, wherein the first locking feature includes a ramp portion that interacts with the first flexible lock member as the connector position assurance insert is being coupled to the first and second housings such that the free floating projection flexes.

14. The connector assembly of claim 11, wherein the first flexible lock member includes a second stop that interacts with the first housing to inhibit movement of the connector position assurance insert from the appropriate locked position.

15. The connector assembly of claim 14, wherein the first stop and the second stop inhibit decoupling of the connector position assurance from the first and second housings.

* * * * *